US006676394B2

(12) United States Patent
Bodzak

(10) Patent No.: US 6,676,394 B2
(45) Date of Patent: Jan. 13, 2004

(54) INTERNAL-GEAR PUMP HAVING A PINION WITH RADIAL PLAY

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/088,672

(22) PCT Filed: Jul. 14, 2001

(86) PCT No.: PCT/DE01/02633

§ 371 (c)(1),
(2), (4) Date: Jun. 11, 2002

(87) PCT Pub. No.: WO02/08608

PCT Pub. Date: Jan. 31, 2002

(65) Prior Publication Data

US 2003/0077196 A1 Apr. 24, 2003

(30) Foreign Application Priority Data

Jul. 21, 2000 (DE) ..... 100 35 900

(51) Int. Cl.[7] ..... F04C 2/10
(52) U.S. Cl. ..... 418/171; 418/109
(58) Field of Search ..... 418/109, 166, 418/171, 182

(56) References Cited

U.S. PATENT DOCUMENTS 2,547,392 A * 4/1951 Hill et al. ..... 418/171
5,226,798 A * 7/1993 Eisenmann ..... 418/109

FOREIGN PATENT DOCUMENTS

| | | | | |
|---|---|---|---|---|
| CH | 262067 | * | 9/1949 | |
| DE | 590394 | * | 12/1933 | |
| DE | 29703656 | * | 6/1997 | |
| GB | 233423 | * | 5/1925 | ..... 418/109 |
| JP | 6-249155 | * | 9/1994 | ..... 418/171 |

* cited by examiner

*Primary Examiner*—John J. Vrablik
(74) *Attorney, Agent, or Firm*—Ronald E. Greigg

(57) ABSTRACT

The invention relates to an internal-gear pump for pumping fuel in an internal combustion engine, having an internal-toothed annular gear and an external-toothed pinion that cooperates with the annular gear to generate a pumping action. To increase the pump capacity at starting rpm and to lengthen the service life of the internal-gear pump, the pinion is supported radially movably, eccentrically to the annular gear, on a bearing journal. Moreover, a device is provided in order to compensate for the radial play (R) between the pinion and the annular gear.

14 Claims, 4 Drawing Sheets

Fig. 1
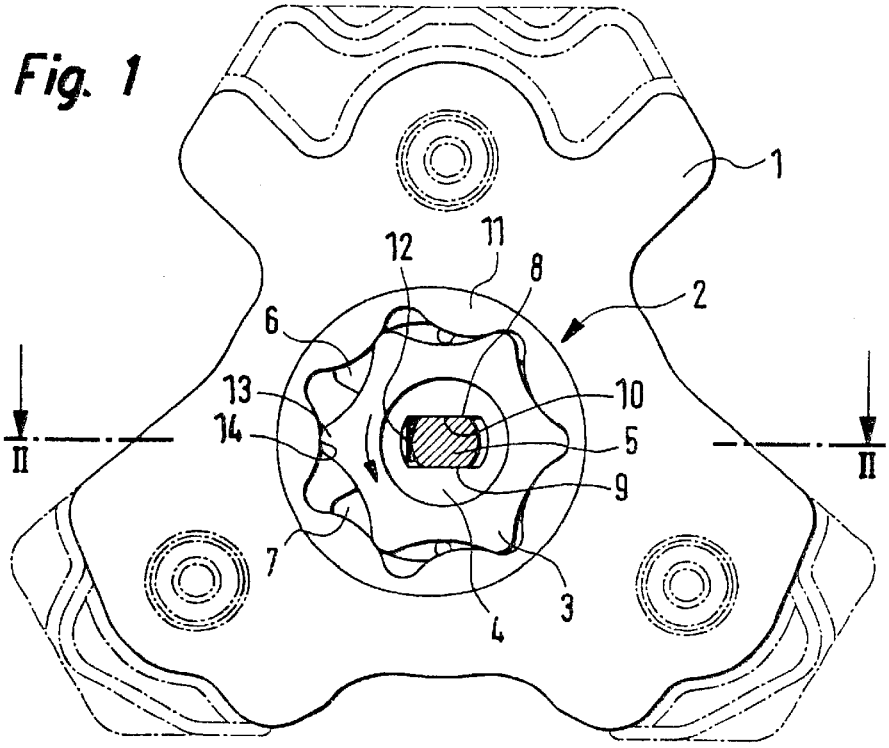
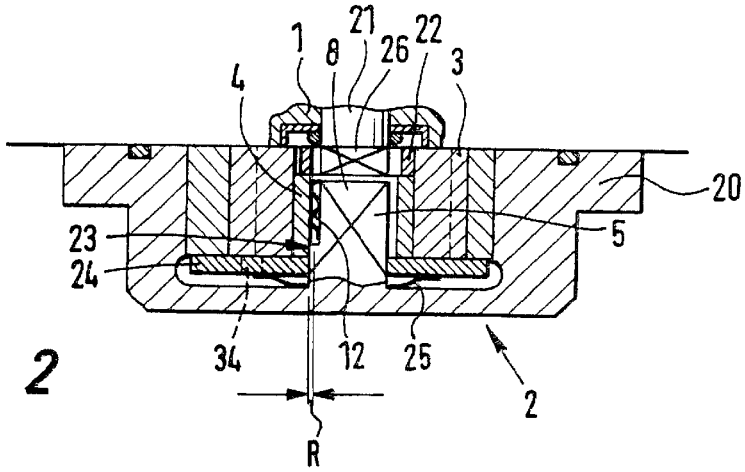
Fig. 2

Fig. 8
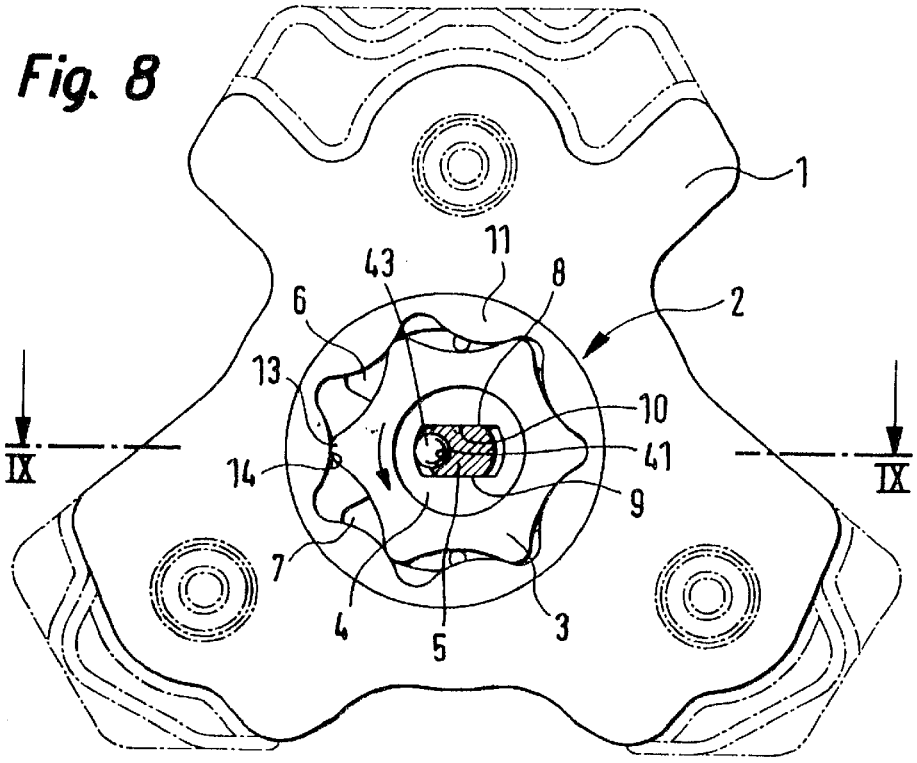
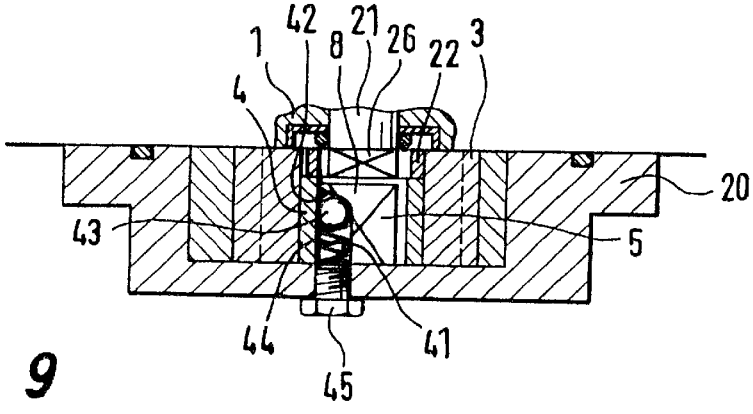
Fig. 9

Fig. 10
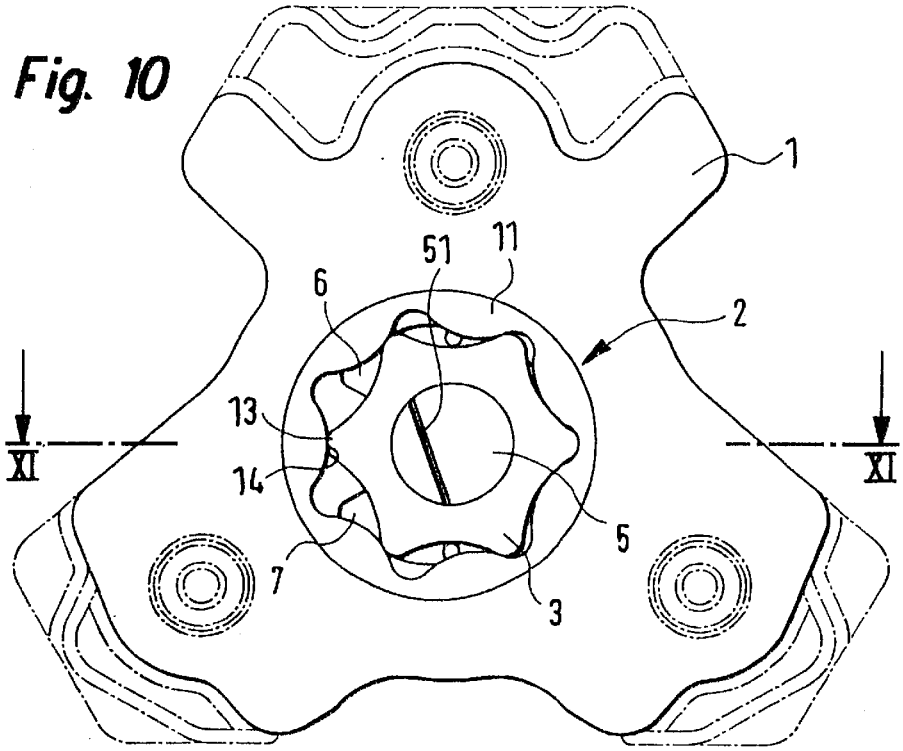
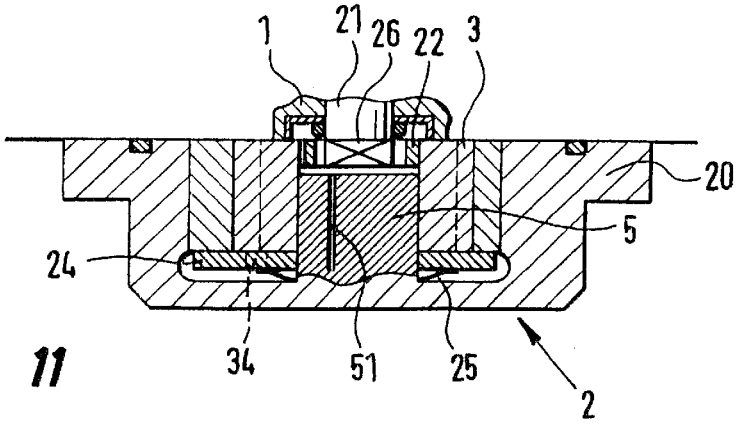
Fig. 11

INTERNAL-GEAR PUMP HAVING A PINION WITH RADIAL PLAY

CROSS-REFERENCE TO RELATED APPLICATIONS

This application is a 35 U.S.C. 371 application of PCT/DE 01/02633, filed on Jul. 14, 2001.

BACKGROUND OF THE INVENTION

1. Field Of The Invention

The invention relates to an internal-gear pump for pumping fuel in an internal combustion engine, having an internal-toothed annular gear and an external-toothed pinion that cooperates with the annular gear to generate a pumping action.

2. Description Of The Prior Art

An internal-gear pump of the type with which this invention is concerned is also known as an annular gear pump or gear-rotor pump. The annular gear and the pinion are the pump elements and are also called an outer rotor and inner rotor. German Patent Disclosure DE 38 27 573 A1 describes an internal-gear pump whose annular gear is driven via an electric motor. The pumping chambers of the internal-gear pump that are located between the sets of teeth of the two pump elements are covered in the axial direction by a thrust washer. A helical spring embodied as a compression spring, which is prestressed against the pressure plate assures that the axial play is zero upon starting of the engine.

OBJECT AND SUMMARY OF THE INVENTION

An object of the invention is to increase the pump capacity at the starting rpm and to lengthen the service life of the internal-gear pump described at the outset. It should also be possible to produce the internal-gear pump economically.

In an internal-gear pump for pumping fuel in an internal combustion engine, having an internal-toothed annular gear and an external-toothed pinion that cooperates with the annular gear to generate a pumping action, this object is attained in that the pinion is supported radially movably, eccentrically to the annular gear, on a bearing journal, and that a device is provided in order to compensate for the radial play between the pinion and the annular gear, especially upon starting of the engine.

Upon engine starting, the pressure in the internal-gear pump is equal to zero. By means of the spring device according to the invention, the end play between two teeth of the pump elements meshing with one another is compensated for upon engine starting. Once the idling rpm is reached, the pump pressure rises and acts counter to the spring force. As a result, the radial play increases, causing the pump capacity to drop and improving the tribological conditions in the pump by increasing the end play.

A particular embodiment of the invention is characterized in that on the circumference of the bearing journal, two flat faces are embodied, which are disposed essentially parallel to the eccentric axis of the internal-gear pump and serve to guide a bearing bush for the pinion in the radial direction. The two flat faces also serve to guide a sealing plate axially for sealing off the pumping chambers of the pump and to secure against a rotary motion of the sealing plate.

A further particular embodiment of the invention is characterized in that the device is formed by a leaf spring with two legs disposed essentially at right angles to one another, one leg being disposed on the face end of the bearing journal and the other leg being disposed between the bearing journal and a bearing bush for the pinion. The spring device is fixed in the built-in state by the leg resting on the bearing journal. The other leg of the spring device serves to compensate for the radial play.

A further particular embodiment of the invention is characterized in that the leg of the leaf spring disposed between the bearing journal and the bearing bush for the pinion is embodied as curved in the longitudinal direction and/or the transverse direction. Embodying the leg as curved assures improved spring action of the leaf spring. The leaf spring can be embodied as singly or multiply curved.

A further particular embodiment of the invention is characterized in that the device is formed by a helical spring, which is disposed between the bearing journal and a bearing bush for the pinion. An indentation for receiving part of the helical spring may be embodied in the bearing journal, in order to keep the helical spring in position in the built-in state.

A further particular embodiment of the invention is characterized in that a stop for the bearing bush is embodied on the bearing journal. The stop serves to limit the radial play after the starting process.

A further particular embodiment of the invention is characterized in that the device for compensating for the radial play is formed by a slit that extends in the longitudinal direction of the bearing journal. Thus in an especially simple way, an elasticity of the bearing journal in the radial direction is made possible. The aforementioned bearing bush and the spring can be dispensed with.

A further particular embodiment of the invention is characterized in that the device for compensating for the radial play is formed by an elongated recess with a chamfer against which a ball is prestressed with the aid of a spring. The more strongly the ball is pressed against the chamfer, the less is the radial play between the pinion and the annular gear. The recess in the bearing journal is designed such that the ball rests both on the bearing journal and on the inner circumference of the bearing bush.

A further particular embodiment of the invention is characterized in that the prestressing force of the spring is adjustable with the aid of a screw. For instance, the screw can be guided in a threaded bore in the housing of the internal-gear pump. By rotating the screw, the prestressing force of the spring and thus the radial play between the pinion and the annular gear can be continuously variably adjusted.

A further particular embodiment of the invention is characterized in that the pinion is coupled to a drive shaft by an Oldham coupling or a radially elastic coupling. An axial offset that may be present between the drive shaft and the bearing journal can be compensated for by the Oldham coupling. The Oldham coupling, which is also known as a cross-disk coupling, moreover makes the radial motion of the pinion required to compensate for the radial play possible.

BRIEF DESCRIPTION OF THE DRAWINGS

The foregoing and other objects and advantages will be apparent from the detailed description contained herein below, taken with the drawings, in which:

FIG. 1, one embodiment of the internal-gear pump of the invention, in plan view;

FIG. 2, the elevation view of a section taken along the line II—II in FIG. 1;

FIG. 8, in plan view, a further embodiment of the internal-gear pump of the invention with an adjusting screw;

FIG. 9, the elevation view of a section taken along the line IX—IX in FIG. 8;

FIG. 10, in plan view, a further embodiment of the internal-gear pump of the invention with a slot; and FIG. 11, the elevation view of a section taken along the line XI—XI in FIG. 10.

DESCRIPTION OF THE PREFERRED EMBODIMENTS

Figure 3:
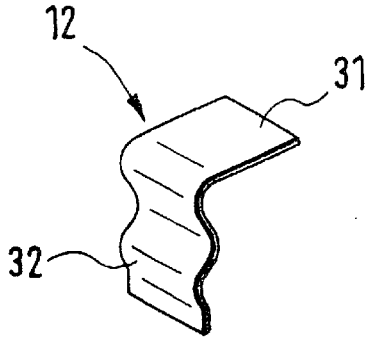
FIGS. 3–5, three different embodiments of a spring device of the invention, seen in perspective.

FIG. 1 shows a high-pressure pump, onto which an internal-gear pump 2 is mounted. In the internal-gear pump 2, an external-toothed pinion 3 is rotatably supported on a bearing journal 5 with the aid of a bearing bush 4. The external-toothed pinion 3 is supported eccentrically to an internal-toothed annular gear 11. The internal-gear pump 2 communicates with the high-pressure pump 1 via an intake conduit 6 and a pressure conduit 7.

Two flat faces 8 and 9 are embodied on the bearing journal 5. The cross section of the bearing bush 4 is in the form of an oblong slot 10, whose dimensions are adapted to those of the bearing journal 5. In the direction of the line II—II, there is some play on both sides between the bearing bush 4 and the bearing journal 5. This makes radial play compensation possible if wear to the bearings and/or gear wheels occurs. To that end, a spring 12 is received on one side in the clearance between the bearing journal 5 and the bearing bush 4. The spring 12 assures that a tooth head 13 of the pinion 3 will kept in contact with a tooth head 14 of the annular gear 11 uicon engine starting.

In the sectional view shown in FIG. 2, it can be seen that the internal-gear pump 2 is surrounded by a housing 20, which is secured to the housing of the high-pressure pump 1. The bearing journal 5 is part of the housing 20 of the internal-gear pump 2. One shaft end 21 protrudes from the high-pressure pump 1 into the internal-gear pump 2. Two flat faces are embodied on the shaft end 21, of which only one face 26 can be seen in FIG. 2. The drive shaft end 21 is received in a coupling part 22. The coupling part 22 is part of a so-called Oldham coupling, which can also be called a cross-disk coupling. The Oldham coupling serves to transmit the rotary motion of the drive shaft end 21 to the external-toothed pinion 3 of the internal-gear pump 2. The Oldham coupling makes it possible to compensate for an axial offset between the drive shaft end 21 and the bearing journal 5.

The radial play of the bearing bush 4 relative to the bearing journal 5 is marked R in FIG. 2. The radial motion of the bearing bush 4 is limited by a stop 23 that is embodied on the bearing journal 5. Within the radial play R, a radial motion of the bearing bush 4 is possible only if the pressure in the internal-gear pump 2 suffices to overcome the prestressing force of the spring 12.

The pump chamber embodied between the outer toothing of the pinion 3 and the inner toothing of the annular gear 11 is sealed off from the housing 20 by a sealing plate 24. To that end, the sealing plate 24 is prestressed against the pinion 3 and the annular gear 11 with the aid of a cup spring 25, which is braced on the housing 20 of the internal-gear pump 2. A bore 34 is provided in the sealing plate 24 and establishes a communication with the compression side.

In operation, the internal-gear pump 2 mounted on the housing of the high-pressure pump 1 is driven by the drive shaft 21 of the high-pressure pump 1. Any axial offset that may occur between the drive shaft end 21 and the bearing journal 5 in the housing 20 is compensated for by the Oldham coupling 22. The Oldham coupling 22 moreover has the task of enabling a radial motion of the pinion 3. The two flat faces 8 and 9 on the bearing journal 5 serve on the one hand to guide the sealing plate 24 axially. On the other, the two flat faces 8 and 9 on the bearing journal 5 serve to guide the bearing bush 4 in the radial direction. To that end, plane faces 8 and 9 on the bearing journal 5 must be oriented approximately parallel to the eccentric axis II—II of the internal-gear pump 2.

Upon starting of the engine, the spring force of the spring 12 acts on the bearing bush 4 and the pinion 3. This reduces the end play 13/14 to zero. Once the engine idling rpm is reached, the pump pressure rises, and the bearing bush 4 moves as far as the stop 23 on the bearing journal 5. Thus over long-term engine operation, the radial play at the tooth heads 13 and 14 is adjusted to a value greater than zero.

Figure 4:
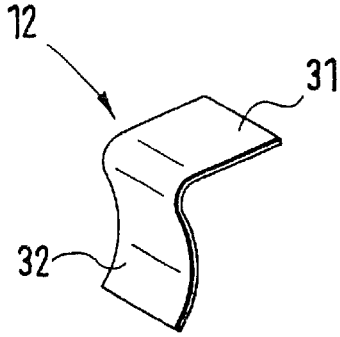
Figure 5:
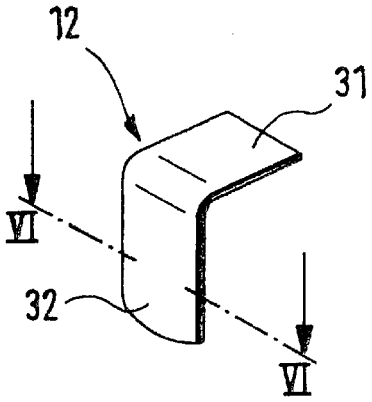

In FIGS. 3–5, three different embodiments of the leaf spring 12 are shown in perspective. For the sake of simplicity, the same reference numerals have been used to designate similar parts. The leaf springs 12 each have two legs 31 and 32, which are disposed at a right angle to one another. The leg 31 of the leaf spring 12 is embodied as flat and in the built-in state rests on the free end of the bearing journal 5.

Figure 6:
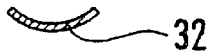
FIG. 6, the elevation view of a section taken along the line VI—VI in FIG. 5.

In the embodiment of the leaf spring 12 shown in FIG. 3, the leg 32 is embodied in curvy fashion in the longitudinal direction. In the embodiment shown in FIG. 4, the leg 32 of the leaf spring 12 is embodied as curved outward or undulating in the longitudinal direction. In the embodiment shown in FIG. 5, the leg 32 of the leaf spring 12 is embodied as curved in the transverse direction. The curvature of the leg 32 is best seen in the cross-sectional view shown in FIG. 6.

Figure 7:
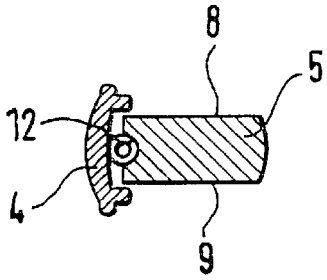
FIG. 7, a detail of FIG. 1, shown in a further embodiment of a spring device of the invention.

In the embodiment of the invention shown in FIG. 7, a helical spring 12 is disposed between the bearing journal 5 and the bearing bush 4 of the pinion 3. The axis of the helical spring 12 extends parallel to the axis of the bearing journal 5. For the fixation of the helical spring 12, an indentation of semicircular cross section is embodied on the bearing journal 5.

The embodiments of the internal-gear pump of the invention shown in FIGS. 8, 9 and 10, 11 are similar to the embodiment shown in FIGS. 1 and 2. For the sake of simplicity, the same reference numerals will be used to designate identical or similar parts. To avoid repetition, only the differences between the various embodiments will be addressed below.

In the embodiment shown in FIGS. 8 and 9, an elongated recess 41 is embodied in the bearing journal 5. The elongated recess 41 takes the form of a circular cylinder, divided in half longitudinally, one face end of which is provided with a chamfer 42. The elongated recess 41 serves to receive a ball 43, whose dimensions are larger than those of the recess 41. This assures that part of the ball 43 will protrude out of the recess 41. This protruding portion of the ball 43 is in contact with the inner circumference of the bearing bush 4.

In the sectional view shown in FIG. 9, it can be seen that the ball 43 is pressed with the aid of a spring 44 against the chamfer 42 in the elongated recess 41. The prestressing force of the spring can be adjusted via a screw 45, whose free end rests on the spring 44. The screw 45 is received rotatably in a threaded bore of the housing 20 of the internal-gear pump.

In the embodiment shown in FIGS. 10 and 11 of the internal-gear pump of the invention, a slit 51 is embodied in the bearing journal 5. The slit 51 is disposed in the longitudinal direction of the bearing journal 5 and, viewed in cross section, takes the form of a chord of a circle. By way of the dimensions of the slit 51, the magnitude of the radial play can be varied.

The foregoing relates to preferred exemplary embodiments of the invention, it being understood that other variants and embodiments thereof are possible within the spirit and scope of the invention, the latter being defined by the appended claims.

I claim:

1. An internal-gear pump for pumping fuel in an internal combustion engine, the pump comprising an internal-toothed annular gear (11) and an external-toothed pinion (3) that cooperates with the annular gear (11) to generate a pumping action, bearing journal means mounting the pinion (3) for radial movement, eccentrically to the annular gear (11), and compensating means to compensate for the radial play (R) between the pinion (3) and the annular gear (11), especially upon starting of the engine, wherein the bearing journal means comprises a bearing journal (5) and, on the circumference of the bearing journal (5), two flat faces (8, 9) are embodied, which are disposed essentially parallel to the eccentric axis of the internal-gear pump (2) and serve to guide a bearing bush (4) for the pinion (3) in the radial direction.

2. The internal-gear pump of claim 1 further comprising a stop (23) for the bearing bush (4) embodied on the bearing journal (5).

3. The internal-gear pump of claim 1 wherein the pinion (3) is coupled to a drive shaft (21) by an Oldham coupling (22).

4. The internal-gear pump of claim 1, wherein the compensating means is formed by a leaf spring (12) with two legs (31, 32) disposed essentially at right angles to one another, one leg (31) being disposed on a face end of the bearing journal (5) and the other leg (32) being disposed between the bearing journal (5) and a bearing bush (4) for the pinion (3).

5. The internal-gear pump of claim 4 further comprising a stop (23) for the bearing bush (4) embodied on the bearing journal (5).

6. The internal-gear pump of claim 4 wherein the pinion (3) is coupled to a drive shaft (21) by an Oldham coupling (22).

7. The internal-gear pump of claim 4, wherein the leg (32) of the leaf spring (12) disposed between the bearing journal (5) and the bearing bush (4) for the pinion (3) is embodied as curved in the longitudinal direction and/or the transverse direction.

8. The internal-gear pump of claim 7 further comprising a stop (23) for the bearing bush (4) embodied on the bearing journal (5).

9. The internal-gear pump of claim 7 wherein the pinion (3) is coupled to a drive shaft (21) by an Oldham coupling (22).

10. The internal-gear pump of claim 1, wherein the compensating means is formed by a helical spring, which is disposed between the bearing journal (5) and a bearing bush (4) for the pinion (3).

11. The internal-gear pump of claim 10 further comprising a stop (23) for the bearing bush (4) embodied on the bearing journal (5).

12. The internal-gear pump of claim 1 wherein the compensating means for compensating for the radial play is formed by an elongated recess (41) with a chamfer (42) against which a ball (43) is prestressed with the aid of a spring (44).

13. The internal-gear pump of claim 12 wherein the prestressing force of the spring (44) is adjustable with the aid of a screw (45).

14. An internal-gear pump for pumping fuel in an internal combustion engine, the pump comprising an internal-toothed annular gear (11) and an external-toothed pinion (3) that cooperates with the annular gear (11) to generate a pumping action, bearing journal means mounting the pinion (3) for radial movement, eccentrically to the annular gear (11), and compensating means to compensate for the radial play (R) between the pinion (3) and the annular gear (11), especially upon starting of the engine.

wherein the bearing journal means comprises a bearing journal (5) and the compensating means for compensating for the radial play is formed by a slit (51) that extends in the longitudinal direction of the bearing journal (5).

* * * * *